US011837454B2

(12) United States Patent
O'Connor et al.

(10) Patent No.: US 11,837,454 B2
(45) **Date of Patent: *Dec. 5, 2023**

(54) USER EXCHANGEABLE ABLATION CELL INTERFACE TO ALTER LA-ICP-MS PEAK WIDTHS

(71) Applicant: Elemental Scientific Lasers, LLC, Omaha, NE (US)

(72) Inventors: Ciaran J. O'Connor, Bozeman, MT (US); Leif C. Summerfield, Bozeman, MT (US)

(73) Assignee: Elemental Scientific Lasers, LLC, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/845,156

(22) Filed: Jun. 21, 2022

(65) Prior Publication Data

US 2022/0344141 A1 Oct. 27, 2022

Related U.S. Application Data

(63) Continuation of application No. 17/145,673, filed on Jan. 11, 2021, now Pat. No. 11,367,604.

(60) Provisional application No. 62/959,865, filed on Jan. 10, 2020.

(51) Int. Cl.
*H01J 49/04* (2006.01)
*H01J 49/10* (2006.01)

(52) U.S. Cl.
CPC ..... *H01J 49/0463* (2013.01); *H01J 49/105* (2013.01)

(58) Field of Classification Search
CPC .. H01J 49/105; H01J 49/0418; H01J 49/0463; G01N 1/10; G01N 1/22; G01N 1/28; G01N 27/64
See application file for complete search history.

(56) References Cited

U.S. PATENT DOCUMENTS

| | | | | |
|---|---|---|---|---|
| 8,174,691 | B1 | 5/2012 | Horton et al. | |
| 11,367,604 | B2 * | 6/2022 | O'Connor | H01J 49/0463 |
| 2004/0045497 | A1 | 3/2004 | Kriews et al. | |

(Continued)

FOREIGN PATENT DOCUMENTS

| | | | |
|---|---|---|---|
| EP | 3240014 | A1 | 11/2017 |
| JP | H11142304 | A | 5/1999 |

OTHER PUBLICATIONS

International Search Report and Written Opinion for Application No. PCT/US2021/012920, dated May 4, 2021.

*Primary Examiner* — David E Smith
(74) *Attorney, Agent, or Firm* — Kevin E. West; Advent, LLP

(57) ABSTRACT

In an embodiment, a laser ablation system can include a laser ablation cell and at least a pair of particle-collection-to-transport-tubing interfaces. The laser ablation cell can be configured for ablating a sample or another material, and the laser ablation cell can include a laser unit. The at least a pair of particle-collection-to-transport-tubing interfaces can be configured to gather an ablated sample and direct the ablated sample to an analysis unit. A selected particle-collection-to-transport-tubing interface can be received by the laser ablation cell directly above the laser unit. The at least a pair of particle-collection-to-transport-tubing interfaces can be configured to be interchangeable with one another.

14 Claims, 3 Drawing Sheets

(56) References Cited

U.S. PATENT DOCUMENTS

| | | | | |
|---|---|---|---|---|
| 2009/0272893 | A1* | 11/2009 | Hieftje | H01J 49/0004 250/288 |
| 2012/0104244 | A1* | 5/2012 | Verbeck, IV | G01N 33/28 250/282 |
| 2013/0162991 | A1* | 6/2013 | O'Connor | G01J 3/0291 250/288 |
| 2014/0070085 | A1* | 3/2014 | Molloy | H01J 49/0463 250/288 |
| 2014/0287953 | A1* | 9/2014 | Gunther | G01N 33/60 506/9 |
| 2016/0049283 | A1 | 2/2016 | Gunther et al. | |

* cited by examiner

USER EXCHANGEABLE ABLATION CELL INTERFACE TO ALTER LA-ICP-MS PEAK WIDTHS

RELATED APPLICATIONS

This application is a continuation under 35 U.S.C. § 120 of U.S. patent application Ser. No. 17/145,673, filed Jan. 11, 2021, and titled "USER EXCHANGEABLE ABLATION CELL INTERFACE TO ALTER LA-ICP-MS PEAK WIDTHS", which in turn claims domestic priority to U.S. Provisional Patent Application No. 62/959,865, filed Jan. 10, 2020, and entitled "USER EXCHANGEABLE ABLATION CELL INTERFACE TO ALTER LA-ICP-MS PEAK WIDTHS."

BACKGROUND

Laser ablation Inductively Coupled Plasma Mass Spectrometry (LA-ICP-MS) or Laser ablation Inductively Coupled Plasma Optical Emission Spectrometry (LA-ICP-OES) techniques can be used to analyze the composition of a target (e.g., a solid or liquid target material). Often, a sample of the target is provided to an analysis system in the form of an aerosol (i.e., a suspension of solid and possibly liquid particles and/or vapor in a carrier gas, such as helium gas). The sample is typically produced by arranging the target within a laser ablation chamber, introducing a flow of a carrier gas within the chamber, and ablating a portion of the target with one or more laser pulses to generate a plume containing particles and/or vapor ejected or otherwise generated from the target (hereinafter referred to as "target material"), suspended within the carrier gas. Entrained within the flowing carrier gas, the target material is transported to an analysis system via a transport conduit to an ICP torch where it is ionized. A plasma containing the ionized particles and/or vapor is then analyzed by an analysis system, such as an MS, OES, isotope ratio mass spectrometry (IRMS), or electro-spray ionization (ESI) system.

DRAWINGS

The Detailed Description is described with reference to the accompanying figures.

DETAILED DESCRIPTION

Figure 1:
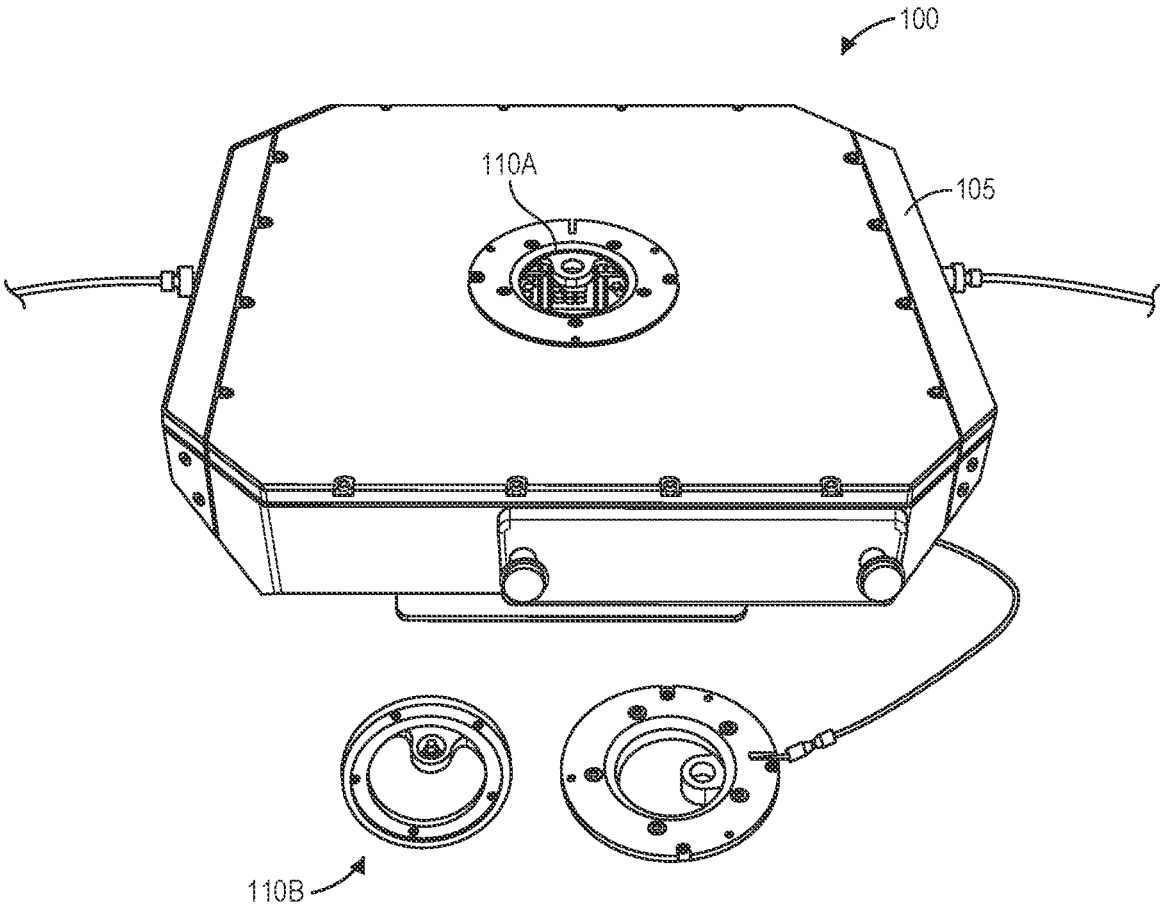
FIG. 1 is a front, isometric view of a laser ablation cell for use with a laser ablation spectrometry system, according to an example embodiment of the present disclosure.

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope.

OVERVIEW

Different applications of LA-ICP-MS can require different aerosol transport capability which can be determined by gas flow geometries in the ablation cell (around the ablation site), the transport region (connective tubing to ICP-MS), and/or even the ICP itself. For instance, "bulk analysis" applications can require a very stable stream of particulate in which particulate generated from one laser pulse overlaps during transport with particulate from subsequent pulses. This can be achieved when the peak widths (of which washout time is the major contributor) are in the region of 1 second(s) for typical laser frequencies employed. The result is a more homogenous aerosol flow and a stable signal on the ICP-MS. In order to achieve peak widths of such time duration, the aerosol can be subject to some dead volumes and a low gas flow velocity regime in which dispersion can occur, which has the effect of broadening the peaks.

When an analyst requires spatial interrogation of the sample, as is the case during elemental imaging (lateral profiling) and depth profiling, it is desirable to avoid the mixing of particulate generated from subsequent laser pulses since spatial resolution can be lost in this way. Typically for such imaging applications, a total peak width in the region of 1-100 ms (milliseconds) is desirable, with shorter peak widths providing potential for higher spatial resolution, and these can be achieved by minimizing dead volumes and transporting the aerosol in a high gas flow velocity regime.

Ablation cell technology and transport technology has historically been optimized for either "bulk analysis" or "spatial analysis". Ablation cells for bulk analysis have had dead volumes designed to capture the aerosol but to allow some dispersion. Further, transport tubing has had a large internal diameter (e.g., 4 mm (millimeters)) such that dispersion occurred during transport, allowing the desired level of mixing/smoothing to be achieved. The aerosol was able to be deposited into the ICP torch, which has quite a large injector diameter again, facilitating the desired level of dispersion.

Ablation cells optimized for spatial work typically eliminate/reduce any dead volume and attempt to entrain the aerosol into the transport region very quickly to minimize dispersion. The transport tubing is typically small internal diameter (e.g., <2 mm) to facilitate a high gas flow velocity and minimize dispersion and peak broadening. The narrow diameter tubing is extended as deep into the ICP as possible to also minimize "in torch" dispersion.

There are a range of problems to overcome. One problem is that these different requirements have generally required different ablation cells. Switching entire ablation cells for different applications is not an ideal solution since it requires multiple cells (which are expensive) and switching can be complex and time consuming. In addition to generally requiring different ablation cells for different applications, the current state of the art typically requires a concordant change in the diameter of the transport tubing which does not provide the level of control or the desired magnitude of change (e.g., cannot generally go from 1 ms to 1 s (second)) and/or uses inserts to "plug" and minimize any dead volume in the ablation cell, namely in the second volume (sometimes referred to as the cup) designed to capture the aerosol and direct to the transport tubing. Again, this use of inserts does not provide the level of change desired, since more drastic changes in this second volume (or cup) design are required that cannot realistically be achieved by inserts. The Helex cell by Teledyne CETAC is a good example of this, and they offer various inserts for their cup. However, this variety of inserts only changes peak widths from 1's to 100's of ms, at best.

In view of such problems, an embodiment of the present system offers a single ablation cell which is designed to enable the user/analyst to change between two or more configurations/modes by simply exchanging the entire particle-collection-to-transport-tubing interface relative to the ablation cell. For example, one particle-collection-to-transport-tubing interface can be used facilitate a fast/imaging mode such that the aerosols are rapidly entrained into a transport region (tube) of narrow internal diameter. Another particle-collection-to-transport-tubing interface can be used facilitate an analytical mode in which an interface is employed such that the aerosols are entrained into a standard cup of dead volume (e.g., a few milliliters (ml)) prior to entering a transport region of wider internal diameter. The interfaces are complete assemblies and can be switched in a few minutes. It is to be understood that other interfaces that facilitate further modes may be employed, so long as they are compatible (e.g., overall size/shape; connection locations) with the ablation cell.

In a second aspect, a significant challenge with high-speed LA-ICPMS plume collection can be the control of the sample and ablation plane to the collection orifice. An interplay of gas-flow dynamics around the ablation site as a function of ablation plane surface to the collection orifice has been observed. If the distance is large, then the ablation plume travel distance and travel time can be increased in a low flow-velocity region between ablation and collection tubing. Of important note, LA-ICPMS signal width is directly driven by total transit time due to the diffusion of nanoparticles in gas suspension. If the distance is too small, the total flow can be restricted from reaching the output orifice and particle plume uptake efficiency can also be reduced.

The work performed with respect to the present system has shown that the ideal sample plane to collection orifice distance is around 100 to 300 microns (μm). This distance can be optimized during setup and maintained during the LA-ICPMS experiment.

There is an additional challenge of having the sample plane close to the output orifice. In a typical three-axis system, X and Y axis control is dedicated to moving the sample around under the laser objective, which is moved in the Z-axis plane to achieve an adjustable focus position for sample of different height. The geometry of the sample to sniffer distance is such that if a given sample height varies by more than a few hundred microns, during pattern planning, it may accidentally scrape a corresponding sample under and across the collection orifice, damaging that sample.

Regarding the standard slow speed collection, when introducing the ability for the user to change from high-speed plume collection to slow plume collection, the sample to collection orifice needs to be considered. Slow plume collection requires a different and much larger distance between sample/ablation plane and the collection orifice due to difference in collection orifice geometries. These requirements for different sample plane heights can require not only changing the sample to output distance, but also the laser focus plane.

EXAMPLE IMPLEMENTATIONS

Figure 2:
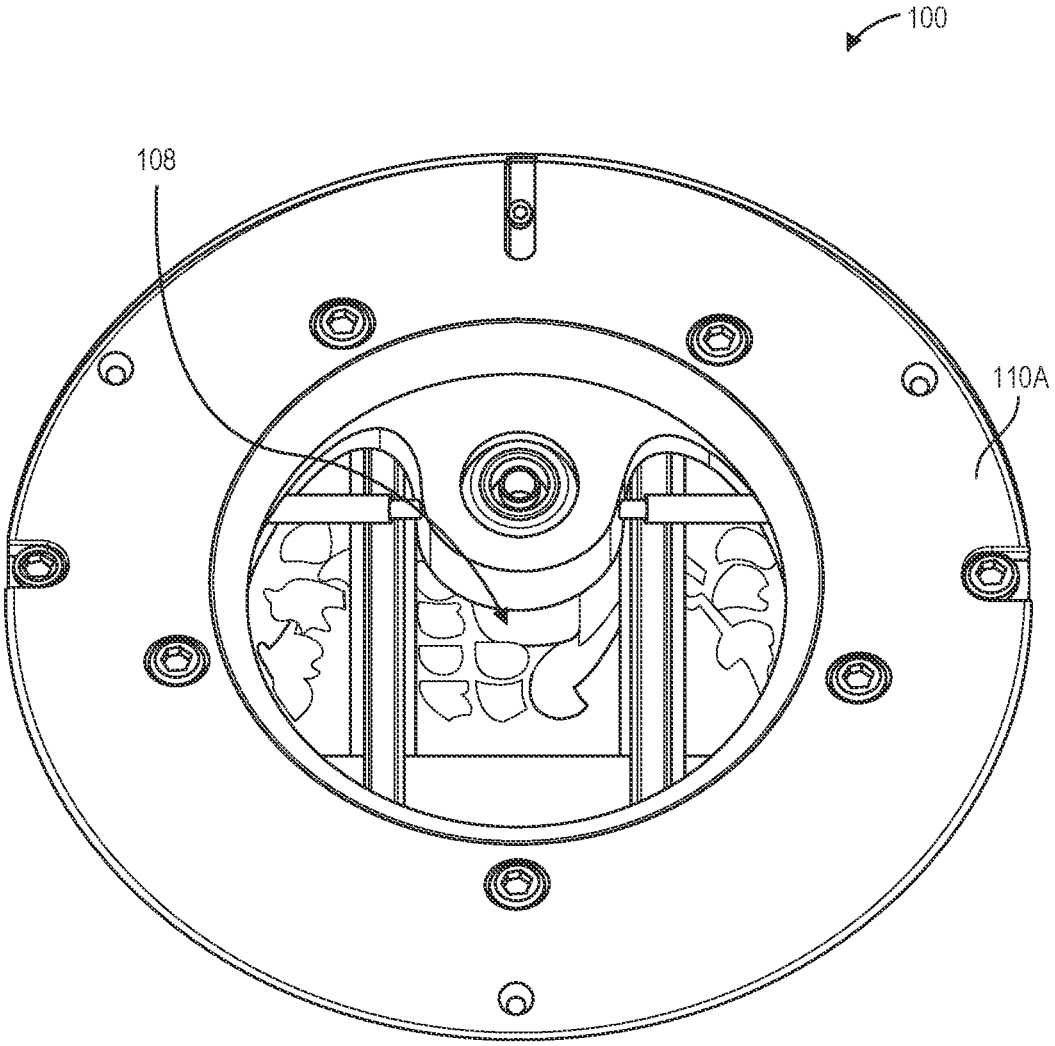
FIG. 2 is a top, isometric, partial view of a laser ablation cell employing a first particle-collection-to-transport-tubing interface for use with the laser ablation cell of FIG. 1.
Figure 3:
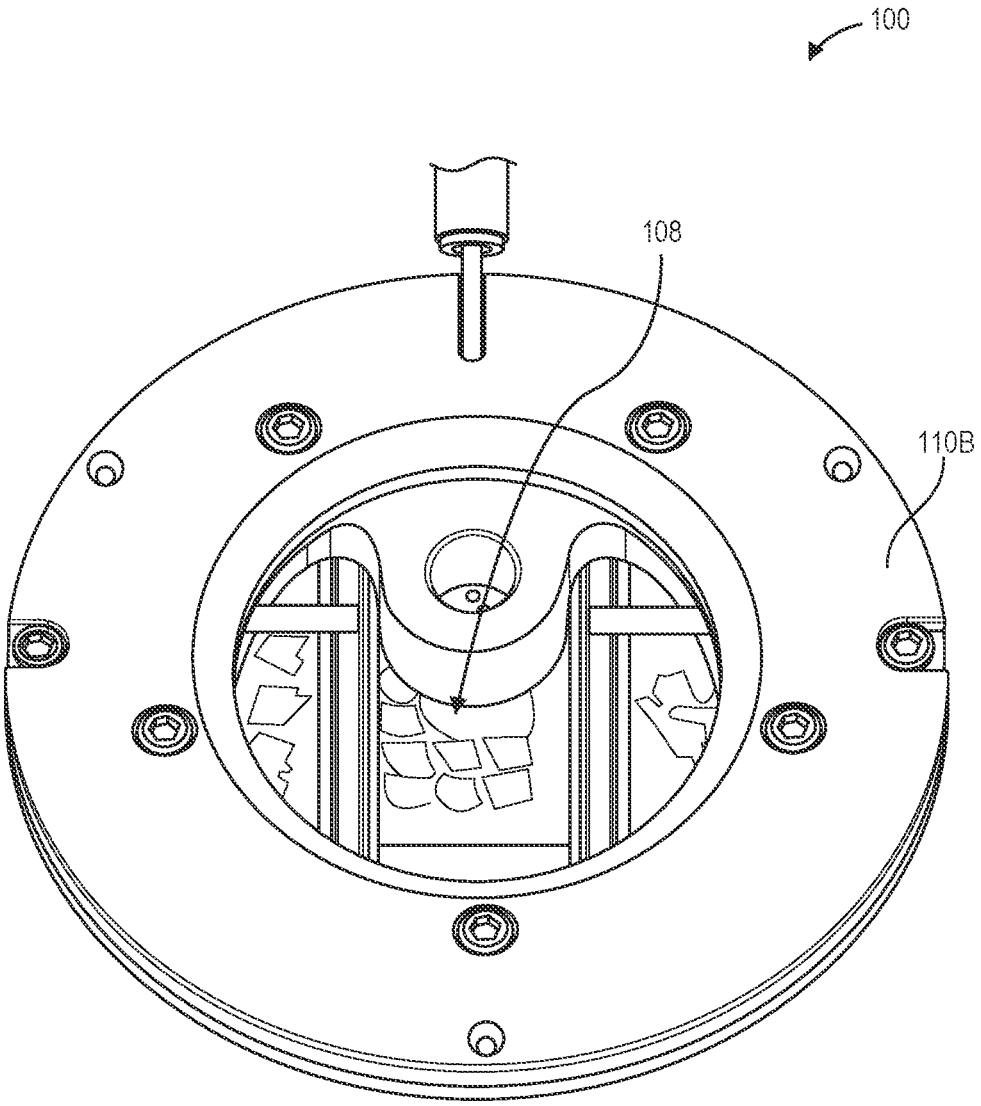
FIG. 3 is a top, isometric, partial view of a laser ablation cell employing a second particle-collection-to-transport-tubing interface for use with the laser ablation cell of FIG. 1.

FIGS. 1-3 illustrate a laser ablation system 100, in accordance with the present disclosure. In an embodiment, the laser ablation system 100 can include a laser ablation cell 105 for ablating a sample or other material, a laser unit 108, and a set interchangeable particle-collection-to-transport-tubing interfaces 110A, 110B. The laser ablation cell 105 can be designed to enable the user/analyst to change, for example, between a pair of configurations/modes by simply exchanging the entire particle-collection-to-transport-tubing interface 110A, 110B. The laser unit 108 of the laser ablation cell 105 can be carried within the laser ablation cell 105. The chosen particle-collection-to-transport-tubing interface 110A, 110B can be received and mounted in the laser ablation cell 105 so as to be positioned directly above the laser unit 108 (e.g., laser diode and related electronics). In an embodiment, the particle-collection-to-transport-tubing interface 110A, 110B can be received between the laser ablation cell 105 and the laser unit 108. The laser unit 108 can thereby be configured to ablate a given sample (e.g., generating a laser and/or ablation plume) to be gathered by a given particle-collection-to-transport-tubing interface 110A, 110B. The given particle-collection-to-transport-tubing interface 110A, 110B can then direct (via a fluid connection) the particles associated with the ablated sample to an analysis unit (not shown). In an embodiment, the interfaces 110A, 110B are complete assemblies and can be switched in a few minutes (e.g., readily switched out for another interface). In an embodiment, a first interface 110A can have a different sample ablation plane to collection orifice distance associated therewith compared to a second interface 110B.

FIG. 1 shows the laser ablation cell 105 with a fast/imaging interface 110A installed, with a close-up of the fast/imaging interface 110A shown in FIG. 2. The analytical mode (slower) interface 110B is shown in front of and apart from the laser ablation cell 105, with the interface 110B interchangeable with the interface 110A. A close-up of the analytical mode interface 110B is shown in FIG. 3. In an embodiment, one given particle-collection-to-transport-tubing-interface (e.g., 110A) is optimized for sampling the laser plume at close distance to enable high speed signal extraction. In an embodiment, one given particle-collection-to-transport-tubing-interface (e.g., 110B) is optimized for slower sampling of an ablation plume to enable slower, more stable signal extraction (e.g., facilitating an analytical mode). It is to be understood that other interchangeable interface units may be employed, based on the situation, so long as the "footprint" and connection points are similar to those of interfaces 110A, 110B.

With regard to the second aspect of the present disclosure, the hardware system can allow control of both the sample to collection orifice distance inside the chamber AND the laser focus plane (e.g., a sample ablation plane). A related software user interface design can automatically change the sample ablation plane to collection orifice distance when the user chooses to switch collection modes (e.g., when switching between interfaces 110A, 110B). The software system can permit the user to pattern-plan at a greater sample-to-collection orifice distance (e.g., as may be dictated by a switch between interfaces 110A and 110B) and when in high-speed mode, and then automatically move the sample AND laser plane up to the ideal high-speed position relative to the output orifice. A software system can allow for easily tuning sample/ablation plane to collection orifice distance for high-speed mode, by selectably changing BOTH laser focus in tandem and equal distance with the ablation plane. This second aspect can be useful when employed with user-changeable second volumes (e.g., as when changing interfaces 110A, 110B).

The laser ablation system 100 may be controlled by a computing system having a processor configured to execute computer readable program instructions (i.e., the control logic) from a non-transitory carrier medium (e.g., storage medium such as a flash drive, hard disk drive, solid-state disk drive, SD card, optical disk, or the like). The computing system can be connected to various components of the analytic system, either by direct connection, or through one or more network connections (e.g., local area networking (LAN), wireless area networking (WAN or WLAN), one or more hub connections (e.g., USB hubs), and so forth). For example, the computing system can be communicatively coupled (e.g., hard-wired or wirelessly) to the controllable elements (e.g., laser ablation cell 105, laser unit 108, and/or particle-collection-to-transport-tubing interfaces 110A, 110B) of the laser ablation system 100. The program instructions, when executing by the processor, can cause the computing system to control the laser ablation system 100. In an implementation, the program instructions form at least a portion of software programs for execution by the processor.

The processor provides processing functionality for the computing system and may include any number of processors, micro-controllers, or other processing systems, and resident or external memory for storing data and other information accessed or generated by the computing system. The processor is not limited by the materials from which it is formed or the processing mechanisms employed therein and, as such, may be implemented via semiconductor(s) and/or transistors (e.g., electronic integrated circuits (ICs)), and so forth.

The non-transitory carrier medium is an example of device-readable storage media that provides storage functionality to store various data associated with the operation of the computing system, such as a software program, code segments, or program instructions, or other data to instruct the processor and other elements of the computing system to perform the techniques described herein (e.g., the aforementioned software system for controlling the various operational aspects of the laser ablation system 100). The carrier medium may be integral with the processor, stand-alone memory, or a combination of both. The carrier medium may include, for example, removable and non-removable memory elements such as RAM, ROM, Flash (e.g., SD Card, mini-SD card, micro-SD Card), magnetic, optical, USB memory devices, and so forth. In embodiments of the computing system, the carrier medium may include removable ICC (Integrated Circuit Card) memory such as provided by SIM (Subscriber Identity Module) cards, USIM (Universal Subscriber Identity Module) cards, UICC (Universal Integrated Circuit Cards), and so on.

The computing system can include one or more displays to display information to a user of the computing system. In embodiments, the display may comprise a CRT (Cathode Ray Tube) display, an LED (Light Emitting Diode) display, an OLED (Organic LED) display, an LCD (Liquid Crystal Diode) display, a TFT (Thin Film Transistor) LCD display, an LEP (Light Emitting Polymer), or PLED (Polymer Light Emitting Diode) display, and so forth, configured to display text and/or graphical information such as a graphical user interface. The display may be backlit via a backlight such that it may be viewed in the dark or other low-light environments. The display may be provided with a touch screen to receive input (e.g., data, commands, etc.) from a user. For example, a user may operate the computing system by touching the touch screen and/or by performing gestures on the touch screen. In some embodiments, the touch screen may be a capacitive touch screen, a resistive touch screen, an infrared touch screen, combinations thereof, and the like. The computing system may further include one or more input/output (I/O) devices (e.g., a keypad, buttons, a wireless input device, a thumbwheel input device, a trackstick input device, and so on). The I/O devices may include one or more audio I/O devices, such as a microphone, speakers, and so on.

The computing system may also include a communication module representative of communication functionality to permit computing device to send/receive data between different devices (e.g., components/peripherals) and/or over the one or more networks. The communication module may be representative of a variety of communication components and functionality including, but not necessarily limited to: a browser; a transmitter and/or receiver; data ports; software interfaces and drivers; networking interfaces; data processing components; and so forth.

The one or more networks are representative of a variety of different communication pathways and network connections which may be employed, individually or in combinations, to communicate among the components of the given laser-ablation-based analytical system. Thus, the one or more networks may be representative of communication pathways achieved using a single network or multiple networks. Further, the one or more networks are representative of a variety of different types of networks and connections that are contemplated including, but not necessarily limited to: the Internet; an intranet; a Personal Area Network (PAN); a Local Area Network (LAN) (e.g., Ethernet); a Wide Area Network (WAN); a satellite network; a cellular network; a mobile data network; wired and/or wireless connections; and so forth. Examples of wireless networks include but are not necessarily limited to: networks configured for communications according to: one or more standard of the Institute of Electrical and Electronics Engineers (IEEE), such as 802.11 or 802.16 (Wi-Max) standards; Wi-Fi standards promulgated by the Wi-Fi Alliance; Bluetooth standards promulgated by the Bluetooth Special Interest Group; and so on. Wired communications are also contemplated such as through Universal Serial Bus (USB), Ethernet, serial connections, and so forth.

The computing system is described as including a user interface, which is storable in memory (e.g., the carrier medium) and executable by the processor. The user interface is representative of functionality to control the display of information and data to the user of the computing system via the display. In some implementations, the display may not be integrated into the computing system and may instead be connected externally using universal serial bus (USB), Ethernet, serial connections, and so forth. The user interface may provide functionality to allow the user to interact with one or more applications of the computing system by providing inputs (e.g., sample identities, desired dilution factors, standard identities, eluent identities/locations, fluid addition flow rates, etc.) via the touch screen and/or the I/O devices. For example, the user interface may cause an application programming interface (API) to be generated to expose functionality to an online dilution control module to configure the application for display by the display or in combination with another display. In embodiments, the API may further expose functionality to configure an inline dilution control module to allow the user to interact with an application by providing inputs via the touch screen and/or the I/O devices to provide desired dilution factors for analysis.

In implementations, the user interface may include a browser (e.g., for implementing functionality of the inline dilution control module). The browser enables the computing device to display and interact with content such as a webpage within the World Wide Web, a webpage provided by a web server in a private network, and so forth. The browser may be configured in a variety of ways. For example, the browser may be configured as an inline dilution control module accessed by the user interface. The browser may be a web browser suitable for use by a full resource device with substantial memory and processor resources (e.g., a smart phone, a personal digital assistant (PDA), etc.).

Generally, any of the functions described herein can be implemented using software, firmware, hardware (e.g., fixed logic circuitry), manual processing, or a combination of these implementations. The terms "module" and "functionality" as used herein generally represent software, firmware, hardware, or a combination thereof. The communication between modules in the given laser-ablation-based analytical system, for example, can be wired, wireless, or some combination thereof. In the case of a software implementation, for instance, a module may represent executable instructions that perform specified tasks when executed on a processor, such as the processor described herein. The program code can be stored in one or more device-readable storage media, an example of which is the non-transitory carrier medium associated with the computing system.

Although the subject matter has been described in language specific to structural features and/or methodological acts, it is to be understood that the subject matter is not necessarily limited to the specific features or acts described above. Rather, the specific features and acts described above are disclosed as examples.

What is claimed is:

1. A particle collection system for a laser ablation system, comprising:

a set of particle-collection-to-transport-tubing interfaces, each particle-collection-to-transport-tubing interface configured to gather an ablated sample from a laser ablation cell in optical communication with a laser unit and direct the ablated sample to an analysis unit, wherein a selected particle-collection-to-transport-tubing interface is configured for positioning above a laser ablation site within the laser ablation cell or received between the laser ablation cell and the laser unit, the set including at least two particle-collection-to-transport-tubing interfaces configured to be interchangeable with one another, and wherein selected particle-collection-to-transport-tubing-interfaces have different geometries which are optimized for different applications.

2. The particle collection system of claim 1, wherein each particle-collection-to-transport-tubing interface has a similar footprint and connection point layout so as to be interchangeably mounted relative to the laser ablation cell.

3. The particle collection system of claim 2, wherein each particle-collection-to-transport-tubing interface is a complete assembly.

4. The laser ablation system of claim 1, wherein one given particle-collection-to-transport-tubing-interface is optimized for sampling the laser plume at close distance to enable high speed signal extraction.

5. The laser ablation system of claim 1, wherein one given particle-collection-to-transport-tubing-interface is optimized for slower sampling of an ablation plume to enable slower, more stable signal extraction.

6. The laser ablation system of claim 5, wherein another given particle-collection-to-transport-tubing-interface is optimized for sampling the laser plume at close distance to enable high speed signal extraction.

7. The laser ablation system of claim 1, wherein a first particle-collection-to-transport-tubing interface of the set has a different sample ablation plane to collection orifice distance within the laser ablation cell associated therewith compared to a second particle-collection-to-transport-tubing interface of the set.

8. A particle collection system for a laser ablation system, comprising:

a set of particle-collection-to-transport-tubing interfaces, each particle-collection-to-transport-tubing interface configured to gather an ablated sample from a laser ablation cell in optical communication with a laser unit and direct the ablated sample to an analysis unit, wherein a selected particle-collection-to-transport-tubing interface is configured for positioning above a laser ablation site within the laser ablation cell or received between the laser ablation cell and the laser unit, the set including at least two particle-collection-to-transport-tubing interfaces configured to be interchangeable with one another.

9. The particle collection system of claim 8, wherein each particle-collection-to-transport-tubing interface has a similar footprint and connection point layout so as to be interchangeably mounted relative to the laser ablation cell.

10. The particle collection system of claim 9, wherein each particle-collection-to-transport-tubing interface is a complete assembly.

11. The laser ablation system of claim 8, wherein one given particle-collection-to-transport-tubing-interface is optimized for sampling the laser plume at close distance to enable high speed signal extraction.

12. The laser ablation system of claim 8, wherein one given particle-collection-to-transport-tubing-interface is optimized for slower sampling of an ablation plume to enable slower, more stable signal extraction.

13. The laser ablation system of claim 12, wherein another given particle-collection-to-transport-tubing-interface is optimized for sampling the laser plume at close distance to enable high speed signal extraction.

14. The laser ablation system of claim 8, wherein a first particle-collection-to-transport-tubing interface of the set has a different sample ablation plane to collection orifice distance within the laser ablation cell associated therewith compared to a second particle-collection-to-transport-tubing interface of the set.

* * * * *